US005510592A

United States Patent [19]

Gentsch et al.

[11] Patent Number: 5,510,592

[45] Date of Patent: Apr. 23, 1996

[54] VACUUM SWITCH

[75] Inventors: Dietmar Gentsch, Ratingen, Germany; Joseph H. F. G. Lipperts, Venlo, Netherlands

[73] Assignee: ABB Patent GmbH, Mannheim, Germany

[21] Appl. No.: 364,537

[22] Filed: Dec. 27, 1994

[30] Foreign Application Priority Data

Dec. 24, 1993 [DE] Germany ..... 43 44 536.5
Sep. 1, 1994 [DE] Germany ..... 44 31 067.6

[51] Int. Cl.[6] ..... H01H 33/66

[52] U.S. Cl. ..... 218/134; 218/135; 218/139

[58] Field of Search ..... 218/118, 121, 218/134, 135, 136, 137, 138, 139, 155; H01H 33/66

[56] References Cited

U.S. PATENT DOCUMENTS 4,394,554 7/1983 Warabi et al. ..... 218/134
4,499,349 2/1985 Sakuma et al. ..... 218/135
4,528,432 7/1985 Senba et al. ..... 218/134
4,757,166 7/1988 Slade ..... 218/134
4,880,947 11/1989 Fey et al. ..... 218/118
4,896,008 1/1990 Aoki et al. ..... 218/134

FOREIGN PATENT DOCUMENTS 3718531 8/1988 Germany ..... H01H 33/66
280604 11/1970 U.S.S.R. ..... H01H 33/66

*Primary Examiner*—J. R. Scott
*Attorney, Agent, or Firm*—Herbert L. Lerner; Laurence A. Greenberg

[57] ABSTRACT

A vacuum switching chamber includes a switching chamber housing having two housing parts. The two housing parts are constructed in the shape of pots or bells and each have a base which encloses an opening through which a respective supporting stalk passes. A stationary contact piece and a moving contact piece are each carried on a respective one of the stalks. The structural size of the vacuum switching chamber is reduced by inwardly drawn bases and furthermore, components and solder foils which would be used in addition to the cylindrical switching chamber housing are rendered unnecessary.

9 Claims, 2 Drawing Sheets

VACUUM SWITCH

BACKGROUND OF THE INVENTION

Field of the Invention

The invention relates to a vacuum switching chamber having an approximately cylindrical switching chamber housing of insulating material, preferably of ceramic, a rod carrying a stationary contact piece engaging one axial end and a rod carrying a moving contact piece engaging another axial end of the housing, and a bellows being mounted on the switching chamber housing, being fastened to the switching chamber housing at one end and being fastened to and enclosing the rod for the moving contact piece at another end.

A vacuum switching chamber of the type mentioned above normally has a tubular body made of insulating ceramic with ends to which metallic terminating covers are fastened. The fastening is carried out by soldering, with the end surfaces of the tubular insulating body being metallized in advance. A stationary contact piece and a moving contact piece are provided in the interior of the switching chamber and are each fastened to a rod. The rods pass through the covers in a vacuum-tight manner and a metallic bellows, which allows the rod to move, is disposed between one of the covers and the rod of the moving contact piece.

Such a vacuum switching chamber has a relatively large structural volume. The different coefficients of expansion of metal and ceramic produce stresses which cannot be ignored, because of the large structural volume.

SUMMARY OF THE INVENTION

It is accordingly an object of the invention to provide a vacuum switching chamber, which overcomes the hereinafore-mentioned disadvantages of the heretofore-known devices of this general type and in which the structural volume is reduced and the number of parts required for closure of the vacuum switching chamber is reduced. In addition, the electrical dielectric strength in air or an insulating gas, for example $SF_6$, is intended to be increased.

With the foregoing and other objects in view there is provided, in accordance with the invention, a vacuum switching chamber, comprising an approximately cylindrical switching chamber housing being formed of insulating material, preferably of ceramic, and having two axial ends and a cylindrical section; a first rod engaging one of the axial ends of the switching chamber housing and carrying a stationary contact piece; a second rod engaging the other of the axial ends of the switching chamber housing and carrying a movable contact piece; a bellows being mounted on the switching chamber housing and having one end being fastened to the switching chamber housing and another end being fastened to and enclosing the second rod; at least one radially inwardly drawn base at least at one of the ends of the switching chamber housing enclosing an opening through which one of the rods passes inwardly, the at least one radially inwardly drawn base being connected to the cylindrical section in the shape of an arc.

In accordance with another feature of the invention, the insulating body includes at least one bowl-shaped or pot-shaped sub-element having a base which is drawn radially inwards in each case with one small opening through which the retaining rods or rods for the stationary contact piece and the moving contact piece are passed. The transition from the base to the cylindrical section is constructed in the shape of an arc.

The arc shape is intended to ensure that the housing runs as parallel to the curved electrical field lines as possible. The structure of the electrical field is calculated by using known methods, for example by using the Liebmann method, on the basis of the shape of the electrodes and of the screen geometry. The structure thus obtained governs the shape of the ceramic body, that is to say especially the arc shape. This arc shape is approximated by bodies of revolution of conical sections or by the combination of sections from the inside, for example by an elliptical, parabolic or hyperbolic shape. The equipotential lines are then at right angles to the surface of the arc-shaped sections. In consequence, the diameter on which the solder joints between the rods and/or bellows and ceramic are formed is also considerably reduced. Therefore, the difference in the thermal expansion is also correspondingly reduced. The electrical dielectric strength is considerably increased as a result of the greater separation of the metallic parts because of the bases. The pot shape or bell shape also prevents a peak in the electrical field, as occurs at the sharp edges of the known cylindrical switching chamber housings.

It is admittedly known for the insulating body to be constructed in the shape of a pot, with the insulating body being drawn inwards at one end and surrounding the rod which is disposed in a stationary manner, as is seen in German Published, Non-Prosecuted Application DE-OS 37 18 531, Soviet Union Patent No. 280 604, and U.S. Pat. No. 4,880,947.

A base which is drawn inwards in the shape of an arc is not illustrated in the case of any of those documents. In the case of the construction according to German Published, Non-Prosecuted Application DE-OS 37 18 531, the base is connected in the shape of a truncated cone virtually without any transition to the cylindrical section. In the case of the construction according to U.S. Pat. No. 4,880,947 and Soviet Union Patent No. 280 604, the transitions between the radially running base and the cylindrical section are illustrated in a more or less angular manner. However, in all of those structures, the surface of the insulating body is not constructed in such a way that it runs as parallel to the curved electrical field lines as possible. Accordingly, the dielectric strength is low in all of those structures.

In accordance with a further feature of the invention, the switching chamber housing is composed of two axially split housing parts, and each housing part can be provided, in the shape of a pot, with a radially inwardly drawn base. For assembly, the free end surfaces of the two housing parts are then firmly connected, for example soldered, while pointing towards one another.

A similar refinement has also been disclosed in Soviet Union Patent No. 280 604.

In accordance with an added feature of the invention, the bellows are connected to the adjacent housing by means of a fastening ring which is fitted on the outer surface of the base.

In accordance with an additional feature of the invention, as an alternative, a lateral surface or side flank of the bellows which is adjacent its free end is attached to the inner surface of the base of the adjacent housing part, preferably with a solder foil being interposed.

In accordance with yet another feature of the invention, the stalk which holds the stationary contact piece has a radially projecting edge rim by means of which it is stopped against the outer surface of the base and of the housing part and is fastened thereto by means of a solder foil.

In accordance with yet a further feature of the invention, there is provided a centering section on that side of the rod which holds the stationary contact piece that points towards the stationary contact piece, the centering section is connected to the edge rim, and the external diameter of the centering section corresponds to the internal diameter of the opening.

In accordance with a concomitant feature of the invention, the bellows has an extension which passes through the opening in the housing part and is dimensioned in such a way that it projects out of the opening. A fastening ring which is provided for retention is firmly soldered to the base surface on the outside of the housing part and to that section of the extension which projects out of the opening, and is fastened thereto in a vacuum-tight manner.

Other features which are considered as characteristic for the invention are set forth in the appended claims.

Although the invention is illustrated and described herein as embodied in a vacuum switching chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
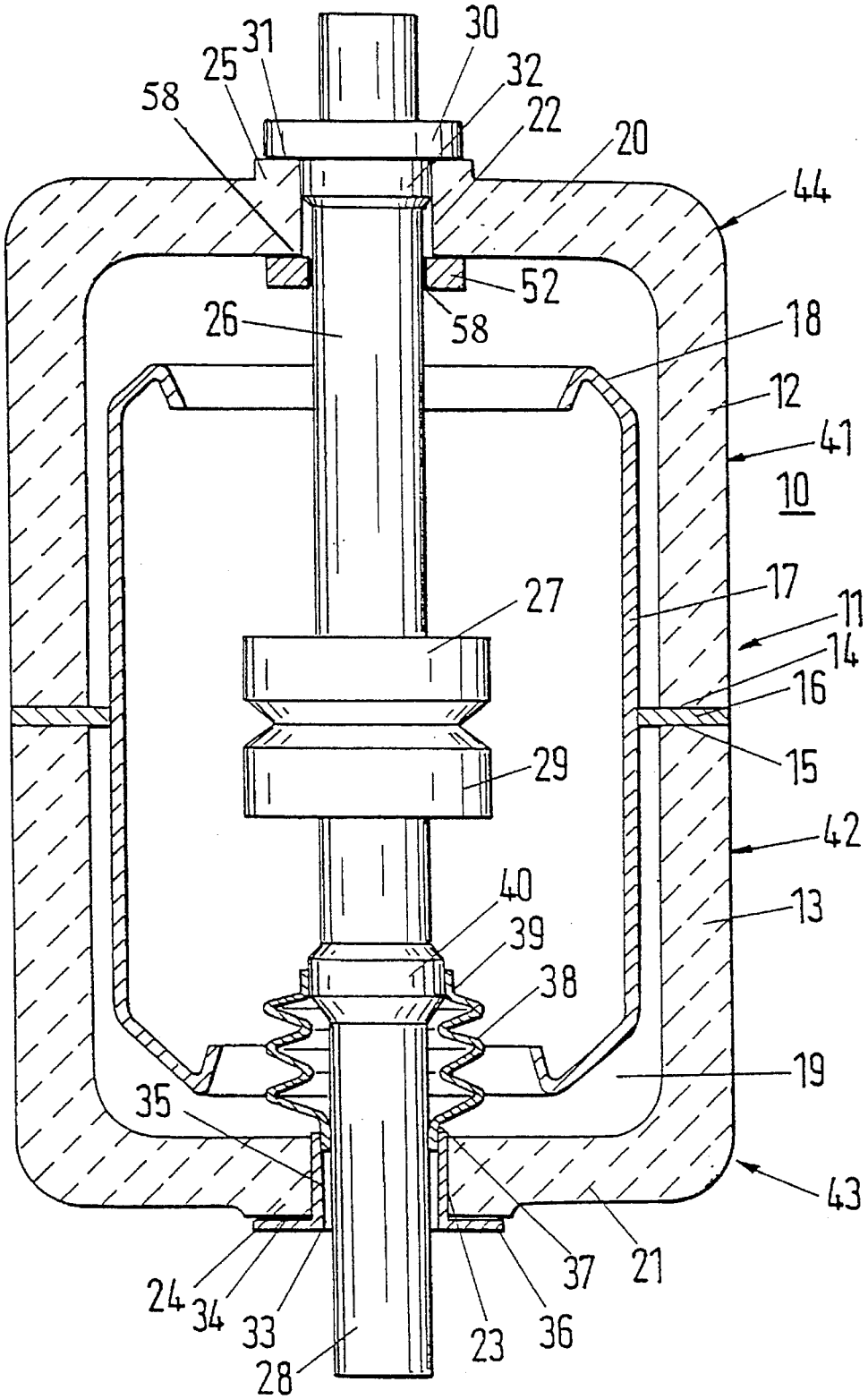
FIG. 1 is a diagrammatic, sectional view of a vacuum switching chamber according to the invention.

Referring now to the figures of the drawing in detail and first, particularly, to FIG. 1 thereof, there is seen a vacuum switching chamber 10 which has a switching chamber housing 11 that is composed of two housing parts 12 and 13. The housing parts 12 and 13 are connected to one another at mutually facing end surfaces 14 and 15 thereof with the interposition of an annular web 16 which projects radially inwards beyond the inner surface of the housing parts 12 and 13. One respective non-illustrated solder foil is provided between the annular web 16 and each of the end surfaces 14 and 15, and the end surfaces 14 and 15 are metallized. A screening cylinder 17, having free ends 18 and 19 which are bent inwards in a U-shape, is fastened to an inner edge of the annular web 16. The housing parts 12 and 13 have ends opposite the end surfaces 14 and 15. The ends have radially inwardly drawn housing bases 20 and 21 each enclosing a respective opening 22 and 23. Axial projections 25 and 24 which are in the form of steps and enclose the openings 22 and 23 are respectively integrally formed on the respective outer surfaces of the housing bases 20 and 21. Of course, the screening cylinder 17 can be fastened in the switching chamber housing 11 in any other manner. This is of minor importance to the invention.

A first rod 26 (which is also referred to as a retaining rod) having an inner end on which a stationary contact piece 27 is fastened, passes through the opening 22. A second rod 28 (which is also referred to as a retaining rod) having an inner end on which a moving contact piece 29 is fastened, passes through the opening 23.

The rod 26 has a radially projecting edge rim 30 having an external diameter which is larger than the internal diameter of the opening 23. This edge rim 30 of the rod 26 is placed against the projection 25 from the outside and is fastened thereto by means of a solder foil 31. In this case, the free, outer surface of the projection 25 is metallized. Adjacent the edge rim 30 on the inside is a centering strip 32 having an external diameter which corresponds to the internal diameter of the opening 22. The opening 22 is sealed in a vacuum-tight manner by permanent soldering of the edge rim 30. This also ensures a good, mechanically loadable fastening of the rod 26 to the housing part 12. An annular molding 52 which is provided on the inside, is made of metal, is fastened to the rod 26 and reinforces the ceramic-metal bond of the rod 26 to the housing part 11. The fastening is carried out by means of a solder ring 58 which is provided between the rod 26 and the molding 52. The distance between the edge rim 30 and the molding 52 is reduced after solidification of the solder and cooling, in such a way that a type of shrinking-on effect is produced, by means of which the base region is firmly pressed around the opening 22, between the molding 52 and the edge rim 30.

A fastening ring 33 of approximately L-shaped cross-section is fastened to the free, outer end surface of the projection 24 with the interposition of a solder foil 34. The free, outer end surface of the projection 24 is likewise metallized. The fastening ring 33 has a cylindrical section 35 and a radially running collar 36. The cylindrical section 35 passes through the opening 23 and the radial collar 36 is fastened to the projection 24 with the interposition of the solder foil 34. A cylindrical collar 37 of a bellows 38 engages in the cylindrical section 35. The bellows 38 has an end which is located inside the vacuum switching chamber 10 and likewise has a cylindrical collar 39 being fastened to a thickened region 40 of the rod 28. A joint between the collar 37 and the cylindrical section 35 of the fastening ring 33 is effected as a welded joint. The fastening of the cylindrical collar 39 of the bellows to the thickened region 40 is likewise effected by welding. Soldering is, of course, also possible in this case. Once again, a vacuum-tight joint and sealing are produced in this case by the solder joint between the radial collar 36 and the projection 24, the cylindrical collar 37 and the cylindrical section 35, and the cylindrical collar 39 and the thickened region 40. The housing parts 12 and 13 each have a cylindrical wall 41 and 42 of a cylindrical section being connected to one of the bases 20 and 21 through a section 43 and 44 which is in the shape of an arc.

As can be seen, in comparison with a conventional vacuum switching chamber, a large flashover length is produced between the collar 36 and the web 16, and between the rim 30 and the web 16, as a result of the sections 43 and 44 which are in the shape of arcs. In consequence, the structural volume can be reduced. As a result of the inwardly drawn bases 20 and 21, closure covers which must be provided in the case of purely cylindrical switching chamber housings can be obviated and a solder foil can be obviated at least at the fastening point of the edge rim 30 to the base 20. As a result of the smaller diameter of the passage of the metal parts, that is to say of the rods 26 and 28, the mechanical intrinsic stress in the ceramic-metal joint is reduced and, since fewer parts need be provided, the overall assembly and storage costs are reduced.

Figure 2:
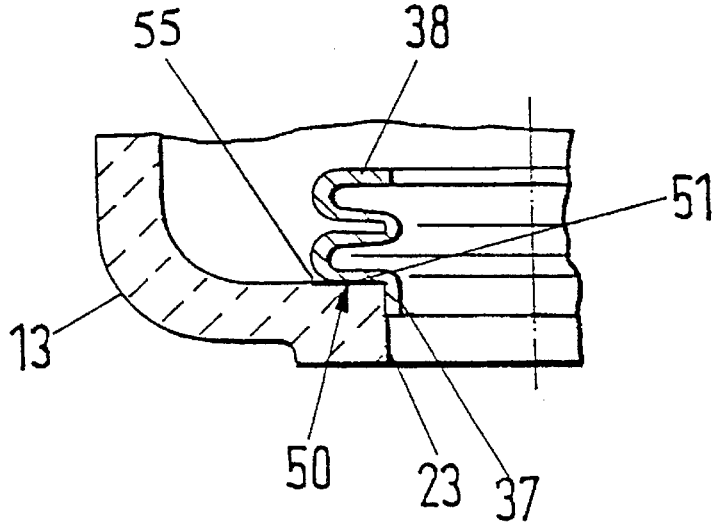
FIGS. 2 and 3 are each fragmentary, partial sectional views of two further embodiments of the invention.

In the case of the construction according to FIG. 2, a lateral surface or side flank 51 of the bellows 38 is fastened to an inner surface 50 of the housing part 13 adjacent the opening 23. The cylindrical collar 37 engages as centering means into the interior of the opening 23. For this purpose, this inner surface region 50 is metallized and is connected to the lateral surface 51 of the bellows 38 by means of a solder foil 55. The fastening of the bellows 28 is thus as is illustrated in FIG. 1.

Figure 3:
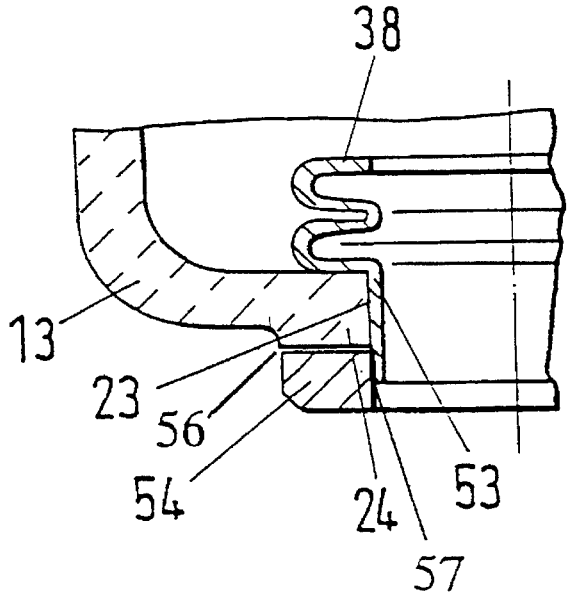

In addition, in the case of the construction according to FIG. 3, the fastening ring 33 of the construction according to FIG. 1 is also omitted. Instead of a short extension for fastening of the bellows 38 in the opening 23, an axial extension 53 is provided which passes through the opening 23 and projects on the outside of the opening in the housing part 13. A ring 54 is placed against the outside of the projection 24, with a solder foil 56 being provided between the ring 54 and the projection 24. An inner surface of the ring 54 engages around the extension 53 outside the opening 23, likewise with the interposition of soldering means 57. If the vacuum switching chamber is ready-soldered, then the ring 54, which is composed of metal, is fastened to the housing part 13 and to the extension 53. It is self-evident that the outer surface of the projection 24 has been metallized in advance.

We claim:

1. A vacuum switch with an internal switching chamber, comprising:

an approximately cylindrical switching chamber housing formed of insulating material and having two axial end segments and a cylindrical section;

a first rod engaging one of said axial end segments of said switching chamber housing and carrying a stationary contact piece;

a second rod engaging the other of said axial end segments of said switching chamber housing and carrying a movable contact piece;

said switching chamber housing with said contact pieces and said rods defining an electrical field with electrical field lines in the internal switching chamber;

a bellows mounted on said switching chamber housing and having one end fastened to said switching chamber housing and another end fastened to and enclosing said second rod; and at least one radially inwardly drawn base at least at one of said end segments of said switching chamber housing, said at least one radially inwardly drawn base enclosing an opening through which one of said rods passes inwardly and being connected to said cylindrical section in the shape of an arc, such that said inwardly drawn base extends essentially parallel to the electrical field lines defined inside the internal switching chamber when said contact pieces are not in mutual contact.

2. The vacuum switching chamber according to claim 1, wherein said switching chamber housing is formed of ceramic.

3. The vacuum switching chamber according to claim 1, wherein said at least one radially inwardly drawn base is one of two pot-shaped radially inwardly drawn bases, said switching chamber housing includes two axially divided housing parts having free end surfaces being firmly interconnected and pointing towards one another, and each of said housing parts has a respective-one of said radially inwardly drawn bases.

4. The vacuum switching chamber according to claim 3, wherein said bellows is adjacent one of said housing parts, said radially inwardly drawn bases have outer surfaces, and including a fastening ring fitted on said outer surface of one of said radially inwardly drawn bases and sealingly connecting said bellows to said adjacent housing part.

5. The vacuum switching chamber according to claim 3, wherein said bellows is adjacent one of said housing parts, said radially inwardly drawn bases have inner surfaces, and said bellows has a free end and a lateral surface adjacent said free end being attached to said inner surface of one of said radially inwardly drawn bases at said adjacent housing part.

6. The vacuum switching chamber according to claim 5, including a solder foil interposed between said lateral surface and said inner surface of said one radially inwardly drawn base at said adjacent housing part.

7. The vacuum switching chamber according to claim 1, wherein said at least one radially inwardly drawn base is one of two pot-shaped radially inwardly drawn bases, wherein said radially inwardly drawn bases have outer surfaces, said first rod has a radially projecting edge rim stopping said first rod against said outer surface of one of said radially inwardly drawn bases, and including a solder foil fastening said edge rim to said outer surface of said one radially inwardly drawn base.

8. The vacuum switching chamber according to claim 7, wherein said opening through which said first rod passes has a given internal diameter, said edge rim has a side facing toward said stationary contact piece, and including a centering section disposed at said side of said edge rim facing towards said stationary contact piece and having an external diameter corresponding to said given internal diameter of said opening.

9. The vacuum switching chamber according to claim 4, wherein said bellows has an extension passing through said opening in said adjacent housing part with a section projecting out of said opening, and including a further said fastening ring firmly soldered and vacuum-tightly fastened to said outer surface of said one radially inwardly drawn base outside said adjacent housing part and is firmly soldered and vacuum-tightly fastened to said section of said extension projecting out of said opening.

* * * * *